US006106359A

United States Patent [19]

Arriola

[11] Patent Number: 6,106,359

[45] Date of Patent: Aug. 22, 2000

[54] TOY FIGURE HAVING WEAPON SWINGING ACTION

[75] Inventor: Martin Arriola, Torrance, Calif.

[73] Assignee: Mattel, Inc., El Segundo

[21] Appl. No.: 09/239,919

[22] Filed: Jan. 29, 1999

[51] Int. Cl.[7] ..... A63H 13/06

[52] U.S. Cl. ..... 446/334; 446/236; 446/330

[58] Field of Search ..... 446/236, 246, 446/307, 330, 334, 335, 336, 352, 390, 473

[56] References Cited

U.S. PATENT DOCUMENTS

| | | | |
|---|---|---|---|
| 3,864,870 | 2/1975 | Breslow et al. . | |
| 3,947,994 | 4/1976 | Meyer et al. . | |
| 3,955,311 | 5/1976 | Lyons et al. . | |
| 4,003,158 | 1/1977 | Wolf et al. . | |
| 4,135,327 | 1/1979 | Sapkus et al. . | |
| 4,161,082 | 7/1979 | Alexander . | |
| 4,545,775 | 10/1985 | Kim . | |
| 4,623,318 | 11/1986 | Tsiknopoulos et al. . | |
| 4,655,725 | 4/1987 | Torres | 446/246 |
| 4,723,932 | 2/1988 | Kelley et al. . | |
| 4,750,900 | 6/1988 | Hart . | |
| 4,801,285 | 1/1989 | Yeu . | |
| 4,802,878 | 2/1989 | Terzian et al. . | |
| 5,727,982 | 3/1998 | Hurt . | |
| 5,925,838 | 7/1999 | Meng-suen | 446/336 |

*Primary Examiner*—Kien T. Nguyen
*Assistant Examiner*—Jeffrey D. Carlson
*Attorney, Agent, or Firm*—Roy A. Ekstrand

[57] ABSTRACT

A toy figure resembling an insect such as an ant includes an upper torso pivotally coupled to a lower torso. A pair of legs support the lower torso and a pivotally moveable shell portion is attached to the lower torso. A drive button is slidingly supported within the lower torso and is raised against the shell portion by an internal return spring operative upon the button. A pair of arms are secured to the upper torso and are pivotable at their respective elbow joints. The arms support hands which in turn receive the handle grips of a simulated weapon each weapon comprising a pivotal arm and an outer ball and weight. A gear and rack mechanism is driven by the slidable button and is coupled to the upper torso by a flexible shaft such that pressing and releasing the shell portion moves the button and gear rack correspondingly to produce pivotal movement back-and-forth of the upper torso which in turn moves the simulated weapons.

10 Claims, 2 Drawing Sheets

TOY FIGURE HAVING WEAPON SWINGING ACTION

FIELD OF THE INVENTION

This invention relates generally to articulate toy figures and particularly to those imitating a fighting or battle activity.

BACKGROUND OF THE INVENTION

Toy figures which participate in fighting or combat type activities are well known in the art. In response to the continuing popularity of such action toy figures, practitioners in the art have endeavored to provide a virtually endless variety of toy figures which provide a fighting or combat or battle type action. Accordingly, toy figures have been provided which shoot weapons, launch projectiles, swing swords, operate various claws and similar implements, activate pincers, provide a punching action and provide a kicking action. Unfortunately, the mechanisms used in providing fighting action toy figures is often unduly complex which in turn leads to a prohibitive cost and or reduction in reliability of the toy figure. Reliability in particular is critical with child users due to the tendency for children to be unduly rough with toys that have movement mechanisms. For example, U.S. Pat. No. 4,003,158 issued to Wolf et al. sets forth a FIGHTING DOLL having a lower torso and a upper torso pivotally coupled and a pair of arms rotatably mounted on the upper torso. Actuating means within the doll cause the upper torso to pivot relative to the lower torso and simultaneously swings one arm upward and the other downward in a fighting motion.

U.S. Pat. No. 4,623,318 issued to Tsiknopoulos et al set forth a FIGURE WITH ROTATABLE TORSO AND VERTICALLY SWINGING ARMS having a upper torso supporting a pair of arms and a lower torso supported by a pair of legs. Pivotal movement of the upper torso with respect to the lower torso causes the arms to swing in response to centrifugal force.

U.S. Pat. No. 4,161,082 issued to Alexander sets forth a FIGURE TOY LIMB HAVING TWIRLING HAND UNIT in which a hollow arm portion support a elongated shaft extending approximately through the forearm portion of the arm. One end of the shaft supports a hand while the remaining end near the elbow supports a thumb wheel. Both the hand and the thumb wheel are secured to the shaft such that rotation of the thumb wheel also rotates the hand.

U.S. Pat. No. 4,750,900 issued to Hart set forth a QUICK DRAW MECHANISM FOR FIGURE TOY in which at least one arm is moveable between a hands-at-the side position and a forwardly extending position characteristic of a cowboy style pistol draw. Spring loaded means within the torso responds to a trigger to rapidly pivot the arm forwardly carrying a simulated pistol into the filing pistol.

U.S. Pat. No. 5,727,982 issued to Hurt set forth a ACTION FIGURE WITH ROTATING ARM MECHANISM operative to rotate an arm or other appendage relative to its torso. The arm is activated by pivoting one leg toward the other against the bias of a spring to pivot an internal level which imparts liner movement in a follower. The follower includes the cam for engaging helical ribs on an arm shaft to convert liner motion to rotary motion of the arm.

U.S. Pat. No. 4,723,932 issued to Kelley et al. sets forth a TOY DOLL HAVING ARTICULATED ARMS AND A TILTABLE UPPER TORSO in which a doll torso is pivotally secured to a leg support unit at the waist in a manner facilitating side-to-side pivotal motion. A mechanism within the doll converts the side-to-side motion of the upper torso into arm motion.

Additional examples of articulated toy figures are found in U.S. Pat. No. 4,545,775 issued to Kim which sets forth a DANCING HULA DOLL and U.S. Pat. No. 4,801,285 issued to yeu which set forth a FIGURE TOY HAVING A THREE-POSITION SWITCH AND TWO MODES OF OPERATION and U.S. Pat. No. 4,135,327 issued to Sapkus et al. sets forth a DOLL CONSTRUCTION WITH PIVOTABLE TOY MEMBERS as well as U.S. Pat. No. 4,802,878 issued to Terzian et al. which sets forth a DOLL WITH ROTATING AND BENDABLE ARMS.

While the foregoing prior art devices have improved the art and in some instances enjoyed commercial success there remains nonetheless a continuing need in the art for evermore improved amusing, entertaining and cost effective toy figures which provide a fighting or battle type action.

SUMMARY OF THE INVENTION

Accordingly, it is the object of the present invention to provide an improved toy figure. It is a more particular object of the present invention to provide an improved toy figure having a weapons manipulating activity. It is a still more object of the present invention to provide an improved toy figure having a low cost and reliable weapons manipulating apparatus.

In accordance with the present invention there is provided a toy figure comprising: a lower torso having supporting legs; an upper torso pivotably coupled to the lower torso; a pair of arms each having a hand and each coupled to the upper torso; a pair of swing-action simulated weapons each coupled to one of the hands, the swing-action simulated weapons each including a freely pivotable member; a shaft having a first end coupled to the upper torso and having a second end extending into the lower torso; and drive means, supported by the lower torso, for rotating the second end of the shaft in a back-and-forth rotational movement; the drive means rotating the shaft to pivot the upper torso and swing or twirl the freely pivotable members of the simulated weapons.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
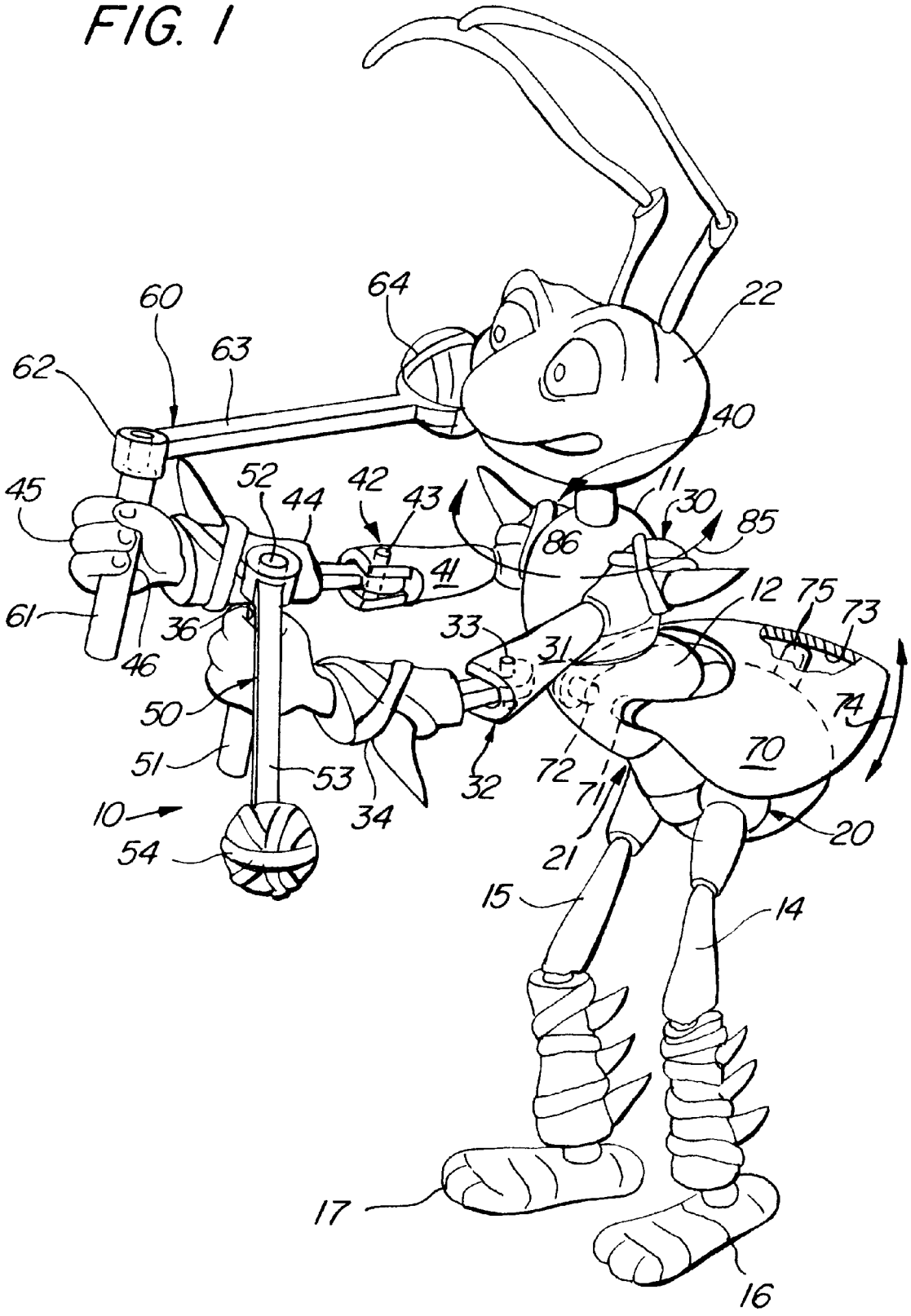
FIG. 1 sets forth a perspective view of a toy figure constructed in accordance with the present invention.

FIG. 1 set forth a partially section perspective view of a toy figure constructed in accordance with the present invention and generally referenced by numeral 10. Toy FIG. 10 is fabricated to resemble a fanciful insect such as an ant having certain human-like characteristics. However, it will be apparent to those skilled in the art that the present invention toy figure may be fabricated to present a variety of selected esthetic themes and appearances without parting with the spirit and scope of the present invention. Toy FIG. 10 includes an upper torso 11 coupled to a lower torso 12 in the manner best seen in FIG. 2 and described below. Suffice it to note here, that upper torso 11 is pivotable with respect to lower torso 12. Lower torso 12 supports hip portions 20 and 21 which in turn support downwardly extending legs 14 and 15 having respective supporting feet 16 and 17. A shell portion 70 defines a notch 76 received upon lower torso 12 and further includes a pair of inwardly extending pins 71 and 72. Pins 71 and 72 are received within respective apertures (such as aperture 24 in FIG. 2) to pivotally secure shell portion 70 to lower torso 12. Lower torso 12 further supports an upwardly extending spring bias button 75 described below in FIGS. 2 and 3 in greater detail. Shell portion 70 defines an under surface 73 upon which shell portion 70 rests against the upper surface of button 75.

In accordance with the present invention, upper torso 11 defines a pair of pivotable shoulder joints 30 and 40 which in turn support a pair of upper arms 31 and 41 respectively. Upper arm 31 is pivotally secured to a forearm 34 by an elbow joint 32. Elbow joint 32 includes a pivot pin 33. Forearm 34 supports a simulated hand 35 having a passage 36 extending downwardly therethrough. Similarly, upper arm 41 is pivotally secured to a forearm 44 at an elbow joint 42. Joint 42 includes a pivot pin 43. Forearm portion 44 further supports a hand 45 defining a downwardly extending passage 46 therein. Upper torso 11 further supports a head 22 which secured to upper torso 11 and pivotable therewith.

In further accordance with the present invention, a weapon 50 having a hand grip 51 received within passage 36 of hand 35 includes a pivot 52 securing a horizontally extending arm 53. A ball 54 is supported by the outer end of arm 53. Similarly, a weapon 60 includes a hand grip 61 received within passage 46 and having a pivot 62 securing a horizontally extending arm 63. The outer end of arm 63 supports a ball 64. Balls 54 and 64 are of sufficient weight to provide freely moveable rotating and pivoting motion of the combinations of arm 53 and ball 54 as well as arm 63 and ball 64 about there respective pivots.

In operation, toy FIG. 10 is positioned upon a play surface to be supported by feet 16 and 17 in a generally erect vertical posture. Thereafter, the user holds FIG. 10 in a convenient grip while forcing shell portions 70 downwardly against lower torso 12. The downward force upon shell portion 70 pivots shell 70 about pins 71 and 72 forcing button 75 downwardly into lower torso 12 in the manner shown in FIGS. 2 and 3. The mechanism operative within lower torso 12 is described below in FIGS. 2 and 3. However, suffice it to note here that each time button 75 is pushed downwardly into lower torso 12, upper torso 11 is rotated in the direction indicated by arrow 85. Conversely, a return spring 99 (seen in FIG. 2) forces button 75 upwardly each time shell portion 70 is released which in turn pivots upper torso 11 in the direction indicated by arrow 86. Thus as the user repeatedly presses shell 70 downwardly against lower torso 12 and releases it and performs this act on a rapidly repetitive basis, upper torso 11 undergoes a correspondingly rapid back-and-forth pivotal movement with respect to lower torso 12 and in the directions indicted by arrows 85 and 86. The freely pivotable couplings at elbows 32 and 42 as well as pivots 52 and 62 of simulated weapons 50 and 60 combine to cause the arms and simulated weapons of FIG. 10 to rapidly move. With some exercise of learning and skill, the child user learns to actuate shell portion 70 to produce circular twirling motions of simulated weapons 50 and 60 through proper timing of the drive mechanism coupled to upper torso 11. The result is an interesting and unusual play pattern in which toy FIG. 10 provides a variety of motion profiles which include erratic virtually random motions at one end of the spectrum and highly precise circular twirling of weapons 50 and 60 at the opposite end of the skill spectrum.

Figure 2:
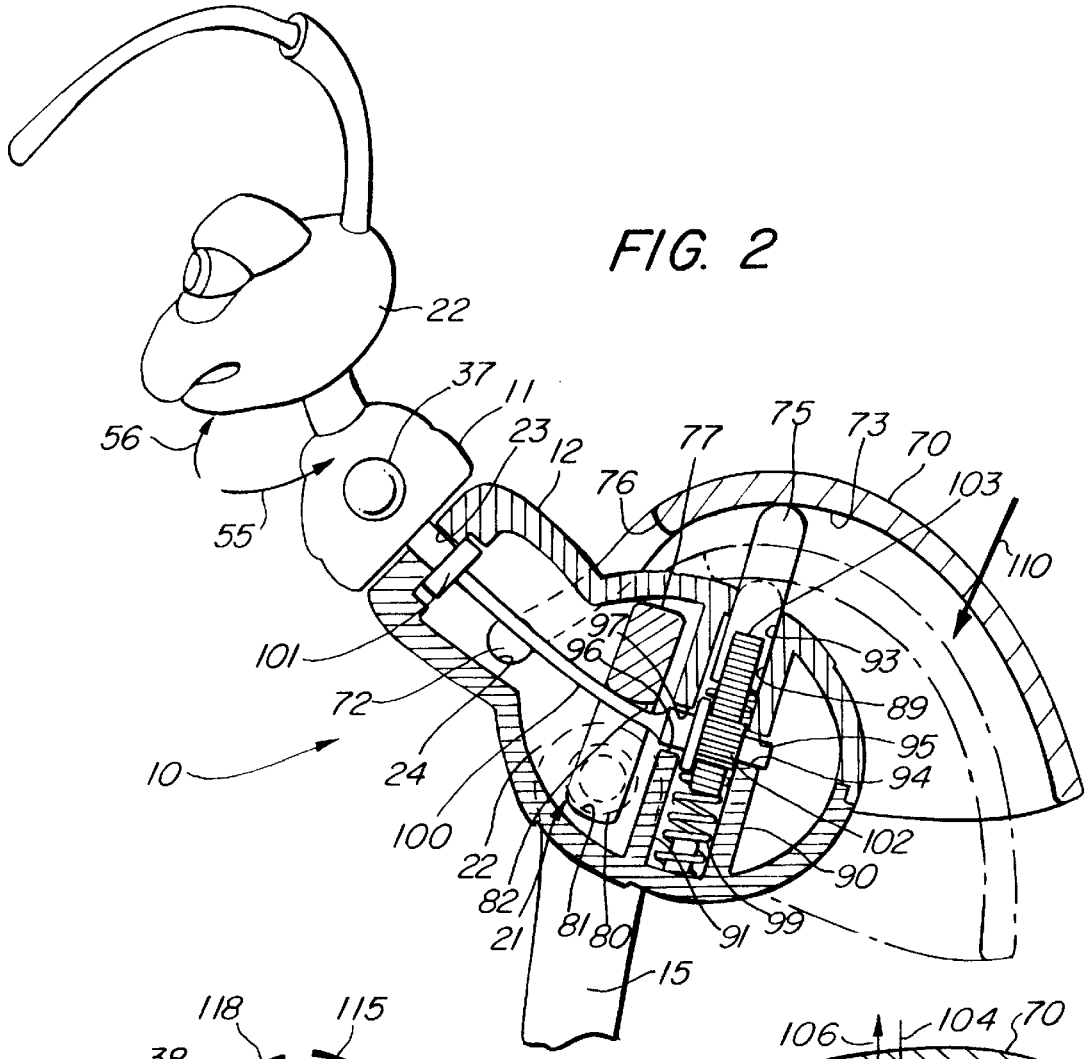
FIG. 2 set forth a partial section view of the present invention toy figure.

FIG. 2 sets forth a partial section view of toy FIG. 10 showing the operative mechanism by which upper torso 11 is pivoted in response to movement of shell portion 70. More specifically, toy FIG. 10 includes a lower torso 12 pivotally secured to an upper torso 11 which in turn supports a head 22. Upper torso 11 supports a pair of shoulder ball members 37 and 38 (member 38 seen in FIG. 4) as described above it will be recalled that shoulder balls 37 and 38 receive upper arms 31 and 41 (seen in FIG. 1) respectively.

Lower torso 12 defines an interior cavity 22 and an aperture 23. Lower torso 12 further defines an aperture 24 and an aperture 93. Lower torso 12 is shown formed of a pair of matting half portions which may be joined using conventional fabrication techniques such as adhesive or the like. A cylindrical boss 90 defining a bore 91 extends upwardly and rearwardly from the lower interior or interior cavity 22. Correspondingly, a boss 92 generally aligned with boss 90 defines an interior passage 89 which extends downwardly from aperture 93. Boss 90 defines a pair of upwardly open notches 94 and 96 while boss 92 defines a pair of downwardly open notches 95 and 97. As a result, the assembly of lower torso 12 brings bosses 90 and 92 into the alignment shown in which notches 94 and 95 corporate to provide a bearing member and in which notches 96 and 97 corporate to form an additional baring member.

A flexible shaft 100 includes an upper bearing 101 supported rotatably within aperture 23 and a gear 102. Gear 102 is rotatable supported by notches 94 and 95 on one side and notches 96 and 97 on the opposite side. A leg support 77 includes a ball joint 80 which is coupled to leg 15 by insertion into a socket 81 to form hip 21. While not seen in FIG. 2 it will be understood that a corresponding fabrication is provided at hip 20 (seen in FIG. 1) to secure leg 14 on the opposite side of lower torso 12. Leg support 77 defines an opening 82 through which flexible shaft 100 passes.

A button 75 is received within aperture 93 and bore 89 in a sliding attachment. Button 75 further supports a gear 103 which engages gear 102 in the manner seen in FIG. 3. A spring 99 is captivated within bore 91 of boss 90 and exerts a upward force against button 75 urging button 75 to the raised shown.

Thus in accordance with the present invention each time shell portion 70 is pushed downwardly in the direction indicated by arrow 110 gear rack 103 is driven downwardly against gear 102 rotating gear 102. The rotation of gear 102 in turn rotates flexible shaft 100, bearing 101, and upper torso 11 together with head 22 in the direction indicated by arrow 55. Conversely, the release of shell portion 70 allows spring 99 to drive button 75 including gear rack 103 upwardly through aperture 93 to the raised position shown in FIG. 2 in solid line representation. Correspondingly, as gear rack 103 moves upwardly against 102, gear 102 is rotated in the reverse direction which in turn rotates flexible shaft 100 bearing 101 upper torso 11 and head 22 in the direction indicated by arrow 56. Thus as the user masters the timing of pressing and releasing shell portion 70, upper torso 11 is caused to undergo various desired pivotal movements in a back-and-forth manner indicated by arrows 55 and 56.

As will be recalled from FIG. 1, the back-and-forth pivotal movement of upper torso 11 produces corresponding movements of the toy figures arms and simulated weapons 50 and 60.

Figure 3:
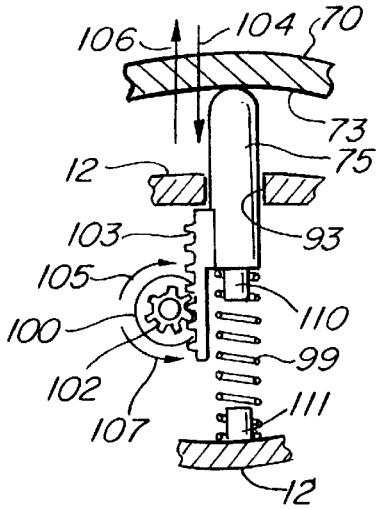
FIG. 3 sets forth a partial section view of the gear and rack portion of the present invention toy figure mechanism.

FIG. 3 sets forth a partial section view of the operative mechanism coupling button 75 to flexible shaft 100. As seen therein lower torso 12 defines an aperture 93 which receives a button 75. Button 75 contacts under surface 73 of shell portion 70 and supports a gear rack 103. A post 110 extends downwardly from the lower end of button 75 and receives one end of captive spring 99. Lower torso 12 further defines an upwardly extending post 111 which receives the remaining end of spring 99. Shaft 100 supports gear 102 in engagement with gear rack 103.

In operation, the spring force of captive spring 99 exerts an upward force against button 75 positioning button 75 in the raised or extended position shown in FIG. 3. Correspondingly, shell portion 70 rests upon the upper end of button 75 at surface 73. Thereafter the user presses shell portion 70 downwardly forcing button 75 in the direction indicated by arrow 104 and overcoming the force of spring 99. The downward movement of button 75 and gear rack 103 rotates gear 105 and shaft 100 in the direction indicated by arrow 105. When the user releases shell portion 70, the force of spring 99 drives button 75 upwardly carrying shell portion 70 and gear rack 103 in the direction indicated by arrow 106. Correspondingly, gear 102 and shaft 100 are rotated in the direction indicated by arrow 107. Thus rapid pressing and releasing of shell portion 70 provides the back-and-forth pivotal motion of shaft 100 which as will be recalled from FIG. 2 produces a corresponding rotation of upper torso 11.

Figure 4:
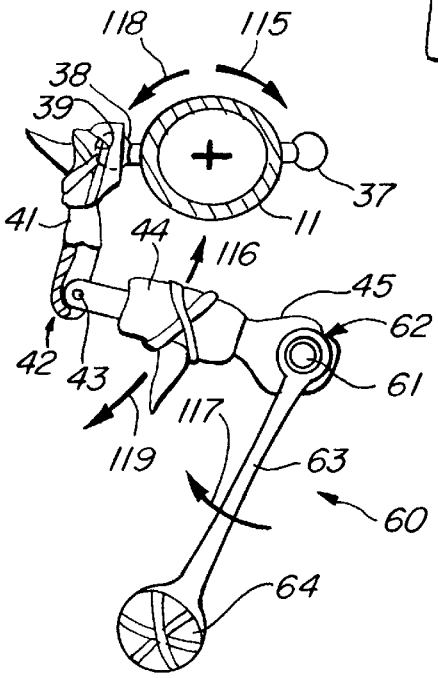
FIG. 4 sets forth a partial top section view of the arm swinging action of the present invention toy figure.

FIG. 4 sets forth a partially sectioned top view of the upper torso arm support and weapon support of the present invention toy figure. Toy FIG. 10 includes an upper torso 11 having a pair of outwardly extending ball members 37 and 38. Upper arm 41 defines a socket 39 received upon ball member 38 to provide a ball and socket attachment. While not seen in FIG. 4 it will be understood that upper arm 31 (seen in FIG. 1) defines a corresponding socket and is received upon ball member 37 in a corresponding attachment. Upper arm 41 is joined to a forearm 44 at a pivotal elbow joint 42. Elbow 42 includes a pivot pin 43. A hand 45 defining an interior passage 46 (seen in FIG. 1) is secured to forearm 44. A weapon 60 includes a hand grip 61 extending into and through passage 46 of hand 45 in the manner seen in FIG. 1. A pivot 62 secures a arm 63 to hand grip 61 and further supports a weighted ball 64.

Thus arm 63 and ball 64 are freely rotatable about pivot 62 while forearm 44 is pivotable in a freely pivoting attachment to upper arm 41.

While not seen in FIG. 4 it will be understood that a corresponding attachment is formed for upper arm 31 in the manner shown in FIG. 1. Thus the descriptions of movement of upper arm 41, elbow 42, forearm 44 and weapon 60 set forth in FIG. 4 will be understood to be equally descriptive of upper arm 31, elbow 32, forearm 34 and weapon 50 (all seen in FIG. 1).

In operation the pivotal movement of upper torso 11 in the back-and-forth direction indicated by arrows 115 and 118 provides corresponding pivotal movement of forearm 44 about elbow 42 in the directions indicated by arrows 116 and 119. Correspondingly, movement of forearm 44 produces pivotal movement of ball 64 and arm 63 of simulated weapon 60. For example, pivotal movement to upper torso 11 in the direction indicated by arrow 118 may force pivotal movement of forearm 44 in the direction of arrow 119 and pivotal movement of arm 63 and ball 64 in the direction indicated by arrow 117. The movement of weapon 60 may be controlled to some extent by the timing of the pivotal movement of upper torso 11. With some skill the user is able to time such movement to convert the pivoting motion of weapon 60 to a circular rotational motion. Various other types of motions are of coarse achievable as the user times successive thrust against shell portion 70 (seen in FIG. 1).

What has been shown is a toy figure having a novel swinging type simulated weapon which responds to a simple press and release of a moveable shell portion on the figures lower torso. The pivoting action of the figures arms are enhanced by a freely pivotal elbow joint in each and by the pivotal attachment of the simulated weapons to the figures hands. The mechanism is mechanical and requires no powered system or batteries of any type and may be readily manufactured of low cost high volume molded components which are easily and efficiently assembled.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy figure comprising:

a lower torso having supporting legs;

an upper torso pivotably coupled to said lower torso;

a pair of arms each having a hand and each coupled to said upper torso;

a pair of swing-action simulated weapons each coupled to one of said hands, said swing-action simulated weapons each including a freely pivotable member;

a shaft having a first end coupled to said upper torso and having a second end extending into said lower torso; and drive means, supported by said lower torso, for rotating said second end of said shaft in a back-and-forth rotational movement;

said drive means rotating said shaft to pivot said upper torso and swing or twirl said freely pivotable members of said simulated weapons.

2. The toy figure set forth in claim 1 wherein said drive means includes:

a button slidably supported by said lower torso and having an outer end:

a shell portion pivotally coupled to said lower torso and contacting said outer end of said button said shell portion pivoting toward said lower torso to depress said button; and a return spring operative to resist depressing of said button.

3. The toy figure set forth in claim 2 wherein said drive means includes:

a gear rack supported upon said button; and a gear joined to said second end of said shaft and engaging said gear rack for rotation in response to movement of said gear rack.

4. The toy figure set forth in claim 3 wherein said shaft includes a flexible portion and is supported in a curved path.

5. The toy figure set forth in claim 4 wherein said lower torso defines an aperture and wherein said button extends therethrough and wherein said return springs is coupled to said button and urges said button outwardly through said aperture.

6. The toy figure set forth in claim 5 wherein each of said arms includes a freely pivotable elbow joint.

7. The toy figure set forth in claim 6 wherein each of said freely pivotable members include an arm and an outer weight.

8. The toy figure set forth in claim 1 wherein said shaft includes a flexible portion and is supported in a curved path.

9. The toy figure set forth in claim 1 wherein each of said arms includes a freely pivotable elbow joint.

10. The toy figure set forth in claim 9 wherein each of said freely pivotable members include an arm and an outer weight.

* * * * *